US005588588A

United States Patent [19]

Byrd

[11] Patent Number: 5,588,588

[45] Date of Patent: Dec. 31, 1996

[54] SIGNAL DEVICE FOR USE WITH A MAILBOX

[75] Inventor: Harold N. Byrd, Purdon, Tex.

[73] Assignee: B&B Partnership, Corsicana, Tex.

[21] Appl. No.: 382,571

[22] Filed: Feb. 2, 1995

[51] Int. Cl.[6] ..... B65D 91/00

[52] U.S. Cl. ..... 232/35

[58] Field of Search ..... 232/17, 34–37

[56] References Cited

U.S. PATENT DOCUMENTS

| | | | |
|---|---|---|---|
| 1,626,320 | 4/1927 | Alms | 232/35 |
| 2,609,787 | 5/1951 | Lawson . | |
| 2,613,031 | 10/1952 | Joyce | 232/35 |
| 2,852,185 | 9/1958 | Stouten | 232/35 |
| 3,958,752 | 5/1976 | Pieszchala . | |
| 4,073,430 | 2/1978 | Joris . | |
| 4,182,479 | 1/1980 | Swift | 232/34 |
| 4,318,507 | 3/1982 | Thopsey et al. . | |
| 4,412,646 | 11/1983 | Hollenbach . | |
| 4,599,965 | 7/1986 | Johnson . | |
| 4,706,880 | 11/1987 | Peters . | |
| 4,720,042 | 1/1988 | Tapy . | |
| 4,728,028 | 3/1988 | Barnes et al. . | |
| 4,875,621 | 10/1989 | Chivers . | |
| 4,964,565 | 10/1990 | Wood . | |
| 5,092,517 | 3/1992 | Jeffries | 232/35 |

*Primary Examiner*—Flemming Saether
*Attorney, Agent, or Firm*—Richards, Medlock & Andrews

[57] ABSTRACT

A delivery signal device for use on a variety of mailbox types is provided. When the mailbox door is opened, a sliding—pivoting mechanism is engaged which releases an indicating member, thereby signaling that mail has been delivered.

13 Claims, 5 Drawing Sheets

SIGNAL DEVICE FOR USE WITH A MAILBOX

TECHNICAL FIELD OF THE INVENTION

This invention relates to a signaling device adapted for use on mailboxes, and especially on rural mailboxes, for indicating from a distance when the mailbox door has been opened, thereby preventing unnecessary trips to the mailbox before the arrival of the mailman.

BACKGROUND OF THE INVENTION

Postal customers, especially those in a rural setting, are generally required to provide a mailbox close to the road. Often times this mailbox is located quite a distance from the mailbox owner's actual residence. As such, it may be difficult and inconvenient to make unnecessary trips to the mailbox to check and see if any mail has been delivered.

To date, numerous mailboxes have been used with designs which provide a visual signaling apparatus which indicates or signals that the mail has been delivered. A signaling apparatus generally includes a flag which is observable from the mailbox owner's residence and movable from one position to another indicating that mail has been delivered. Such signaling may be triggered consciously and manually by the postal carrier or automatically when the mailbox door is opened by the postal carrier. Many of these signaling devices are mounted on the exterior ends or sides of the mailbox where they are directly exposed to the sun's rays and inclement weather.

Thus, there is a need for an improved apparatus which signals when the postal carrier opens the mailbox door and delivers the mail. The present invention provides for an improved signaling apparatus for use with a mailbox for indicating that mail has been delivered. The advantages of the present invention include a signaling apparatus that is durably constructed, inexpensive to manufacture, easily installed, constructed of a minimal number of parts, sheltered from the weather, positive in action, attractive in appearance, and can be positioned to produce the maximum observability from the mailbox owner's residence.

SUMMARY OF THE INVENTION

Accordingly, the present invention provides a mailbox signaling device which is simple to install and operate, extremely reliable in operation, and yet inexpensive to manufacture. A first embodiment of the device is intended for use on a mailbox having a door where the bottom edge of the mailbox door or another structure moves beneath the front end of the mailbox and rearward when the door is opened. The delivery signal device includes an angle plate having a top portion and a side portion, the top portion having a means for attaching the angle plate to the downward facing side of the mailbox. The side portion of the angle plate depends from the top portion in a generally vertical direction and has first and second ends. The first end of the side plate is disposed toward the front end of the mailbox and has a pivot pin formed thereon. The second end of the side plate is disposed toward the rear end of the mailbox and has a pair of rearward extending arms forming a rearward opening notch therebetween. The upper arm is of greater length than the lower arm thus, forming a shoulder on the upper side of the notch. The delivery signal device further includes a lever member having a shank member and an indicating member. The shank member has first and second ends in a central portion. The central portion of the shank member has an elongated slot which engages the pivot pin on the side portion of the angle plate thereby allowing the shank to both translate and pivot relative to the angled plate. A friction surface is formed at the first end of the shank member. An indicating member is mounted on the second end of the shank portion. The indicating member is dimensioned so that it will engage the notch in the angle plate when the lever member is pivoted until the shank portion encounters the shoulder and the lever member is further translated into a forward position. When the mailbox door is opened, the first end of the lever member is translated rearward, causing the indicating member to disengage the notch in the angle plate. The lever member then pivots downward about the pivot pin, thereby displaying the indicating member and signaling that the mail has been delivered.

Additional embodiments of the current invention are given describing various means for attaching the angle plate to the downward facing side of the mailbox. Further embodiments describe preferred configurations for the indicating member.

Another embodiment describes a kit for mounting a delivery signal device of the current invention on a mailbox.

Still another embodiment describes a delivery signal system having an alternative configuration of the slide-pivot mechanism.

DETAILED DESCRIPTION

Figure 1:
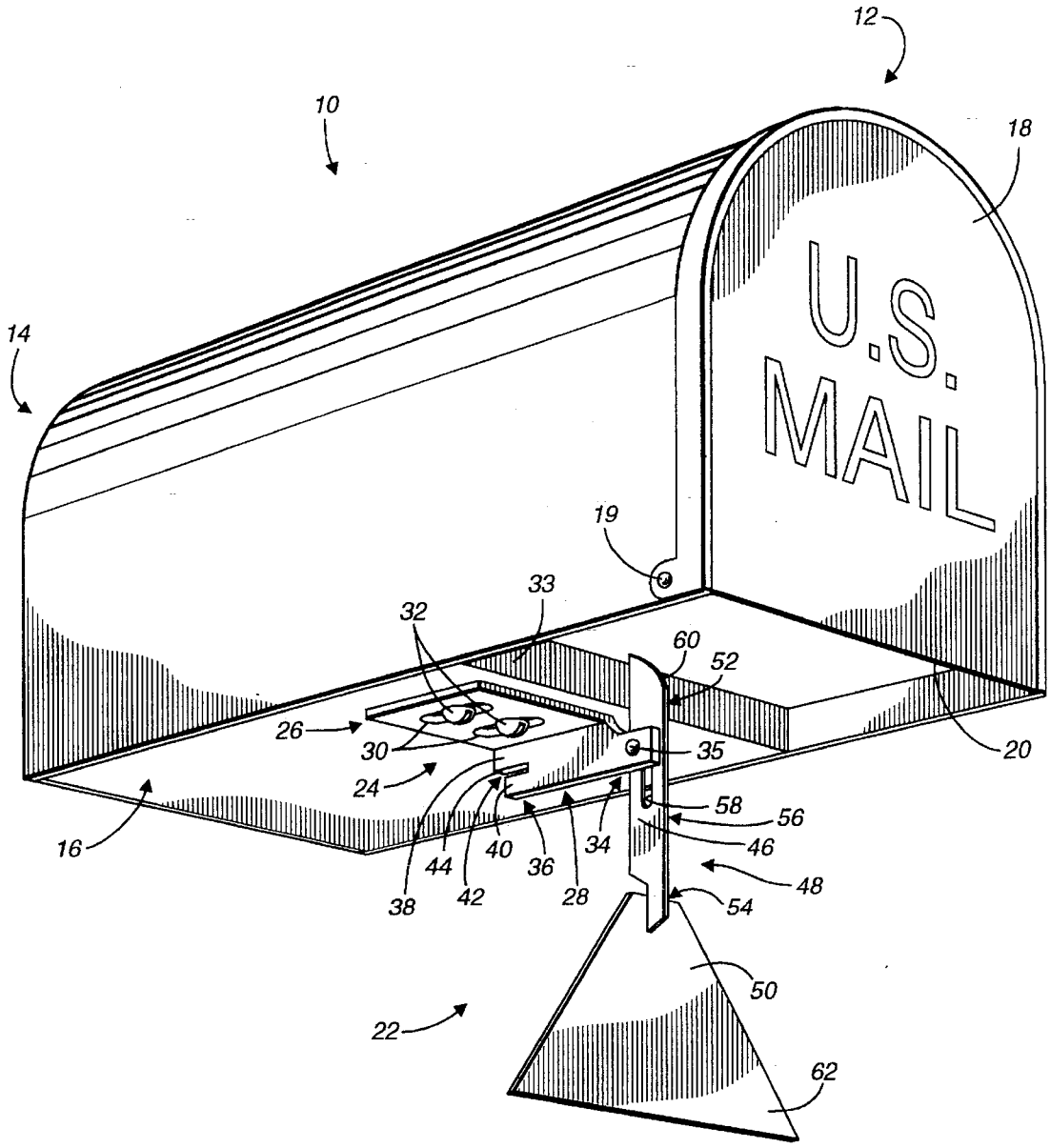
FIG. 1 is a perspective view of a typical mailbox having "offset" hinges equipped with a delivery signal device constructed in accordance with the present invention where the signal flag is in its signaling position.
Figure 2:
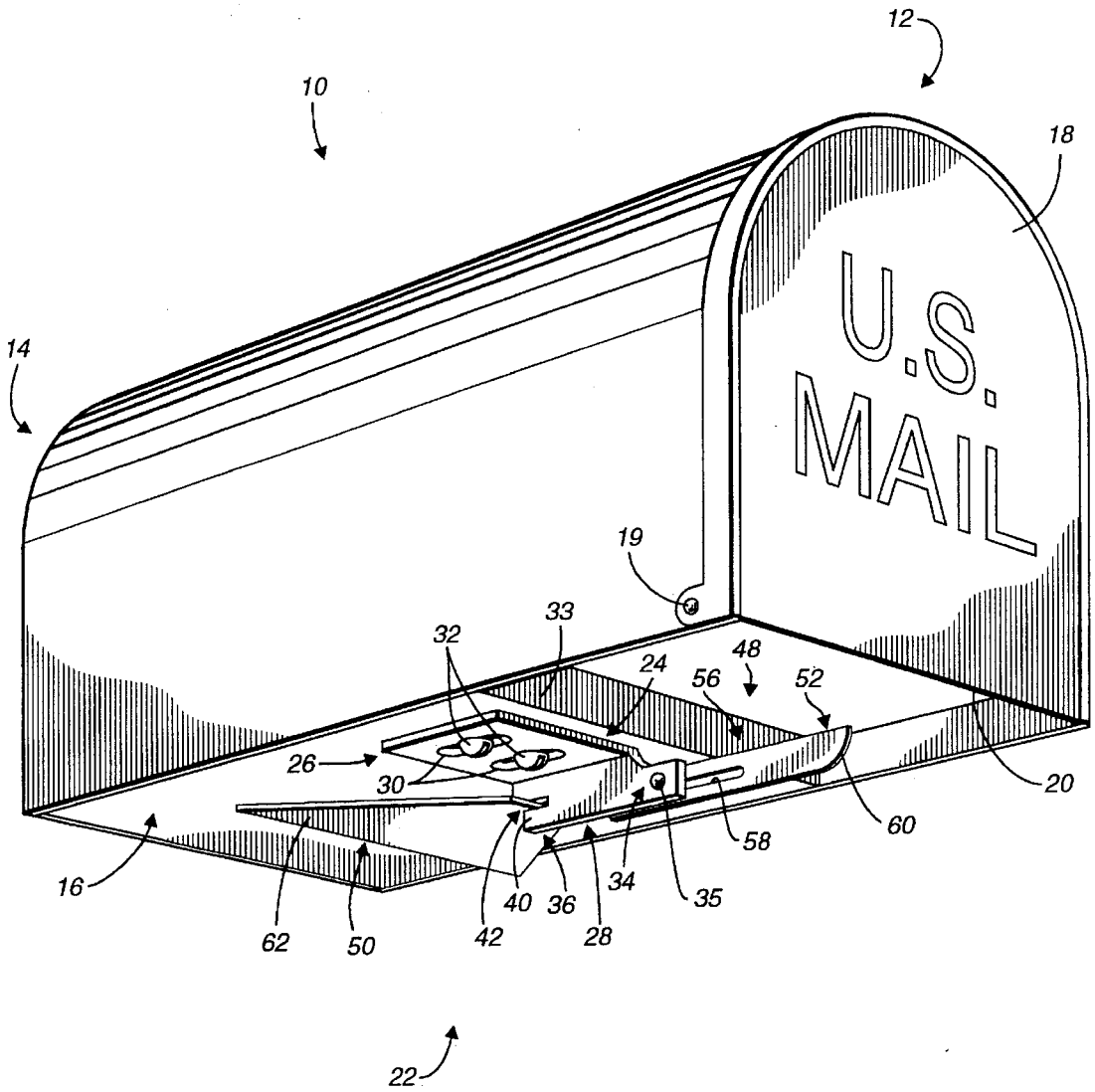
FIG. 2 is a perspective view of the mailbox and delivery signal device of FIG. 1 where the signal flag is in its nonsignaling position.
Figure 3:
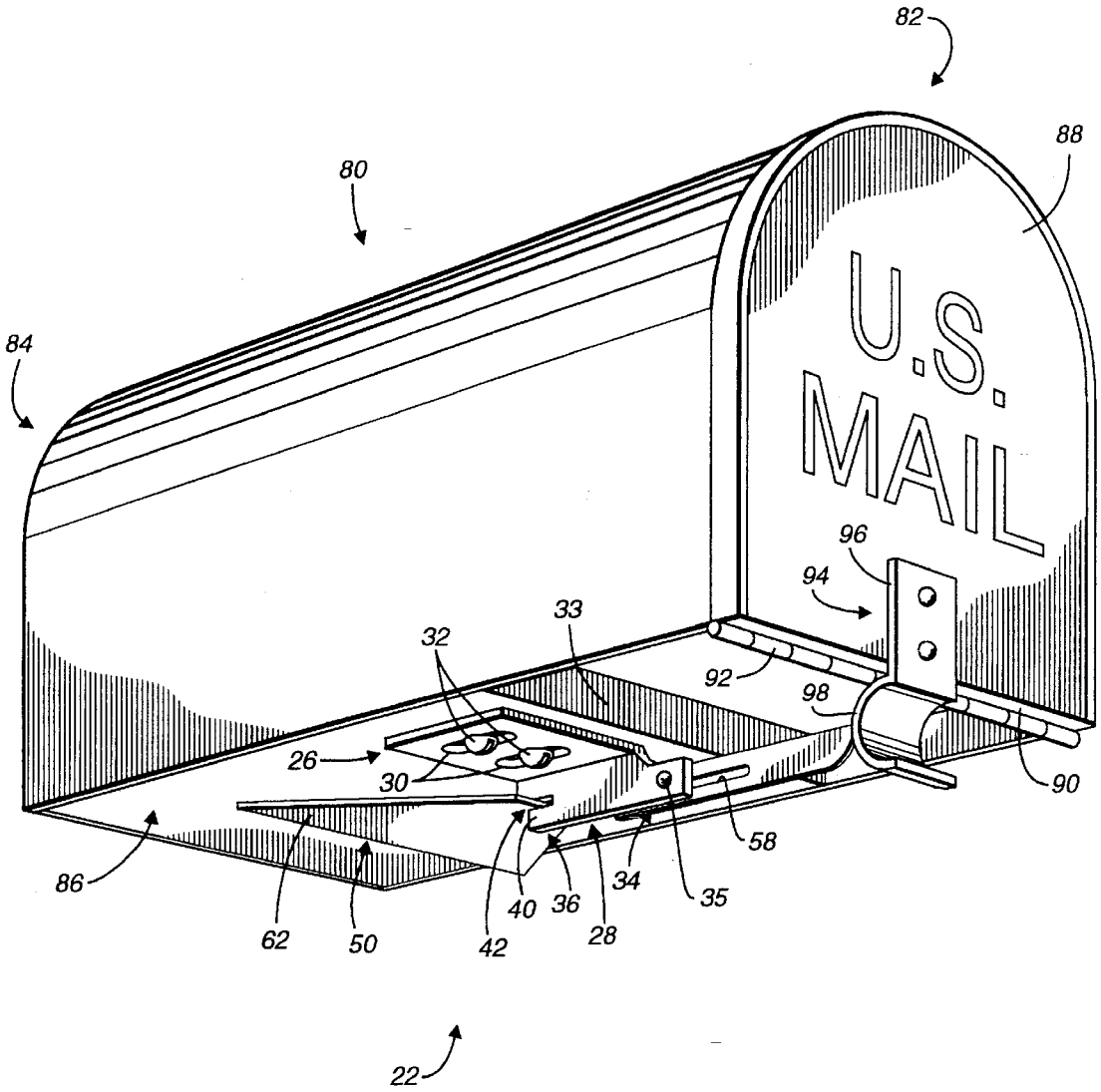
FIG. 3 is a perspective view of a typical mailbox having "piano" hinges equipped with a delivery signal device constructed in accordance with the present invention where the signal flag is in its nonsignaling position.
Figure 4:
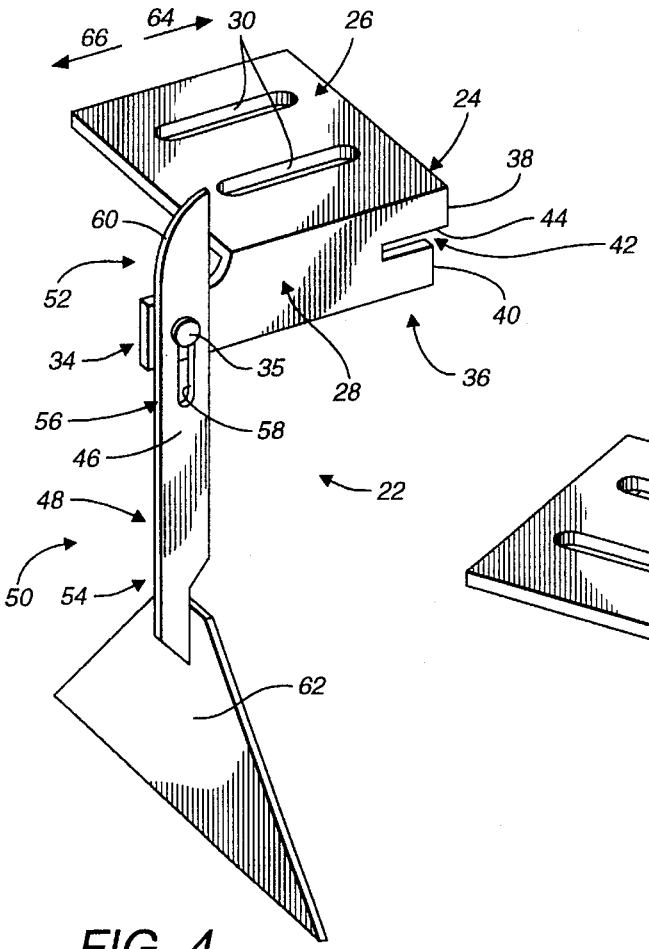
FIG. 4 is perspective view of the delivery signal device constructed in accordance with the present invention in its signaling position without the mailbox shown.
Figure 5:
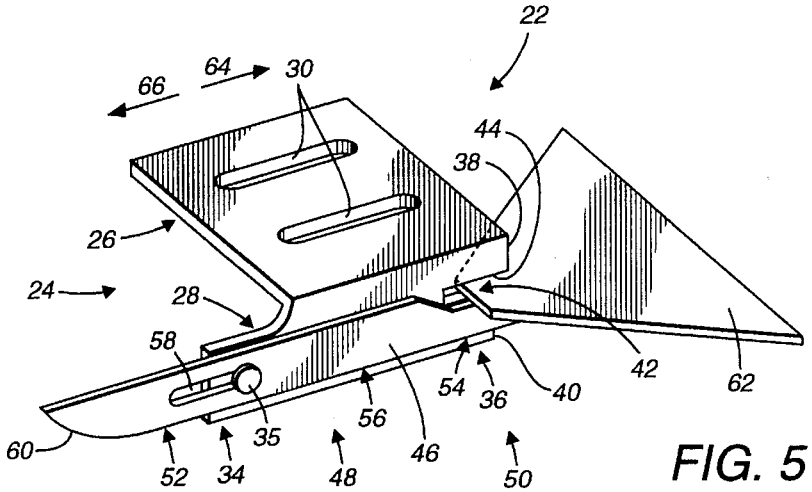
FIG. 5 is perspective view of the delivery signal device of FIG. 4 in its nonsignaling position without the mailbox shown.
Figure 6:
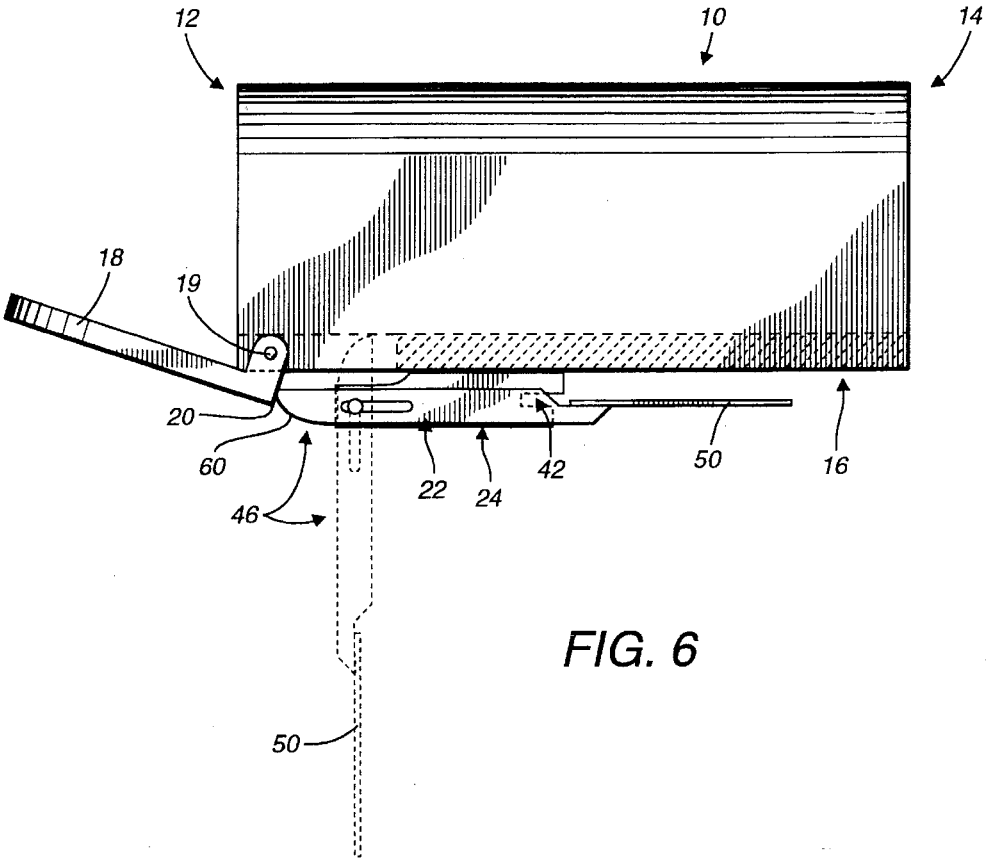
FIG. 6 is a side elevation view of the present invention mounted on a typical mailbox having "offset" hinges where the mailbox door is opened showing the movement of the signaling device from a nonsignaling position to the signaling position (shown in dotted lines).
Figure 7:
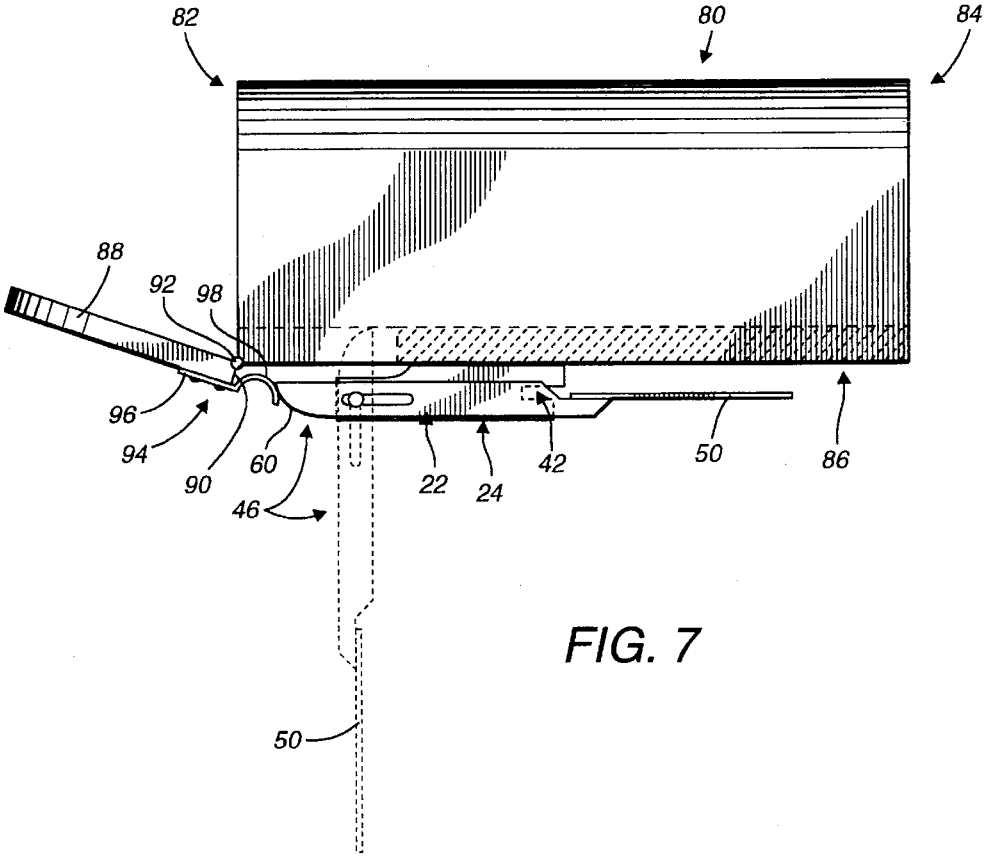
FIG. 7 is a side elevation view of the present invention mounted on a typical mailbox having "piano" hinges and where the mailbox door is equipped with a cam plate where the mailbox door is opened showing the movement of the signaling device from a nonsignaling position to the signaling position (shown in dotted lines).

Referring to FIGS. 1, 2, 3, 4, 5, 6 and 7, wherein like reference numerals refer to like components in the figures, FIGS. 1, 2 and 6 show a signaling device constructed according to the current invention mounted on a typical mailbox having "offset" hinges. FIGS. 3 and 7 show a signaling device constructed according to the current invention mounted on a typical mailbox having "piano" hinges. FIGS. 4 and 5 show the signaling device alone.

Referring to FIGS. 1, 2 and 6, the mailbox 10 has a front end 12, a rear end 14, a downward facing side 16, and a door 18 positioned near the front end. The door 18 is attached to the mailbox with hinges 19 which are offset from the bottom edge 20 of the door 18. As shown in FIG. 6, when the door 18 is opened, the bottom edge 20 will move downward and rearward due to the offset location of the hinges. A delivery signal device 22 constructed according to the current invention is shown attached to the downward facing side 16 of the mailbox 10. FIGS. 4 and 5 show the device 22 without the mailbox for greater clarity. The delivery signal device 22 includes an angle plate 24 having a top portion 26 and a side portion 28. The top portion 26 is oriented generally horizontal and may be used for attaching the angle plate 24 to the downward facing side 16 of the mailbox 10. In this embodiment, a spacer member 33 has been affixed to the downward facing side 16 of the mailbox. Slots 30 are formed in the top portion 26 of the angle plate 24, allowing the angle plate to be adjustably attached to the spacer member 33 using fasteners 32. The spacer plate 33 may be constructed of wood, particle board, plastic, or other materials appropriate for sheltered outdoor use. Depending on the configuration of the downward facing side 16 of the mailbox, the spacer plate 33 may be omitted in certain circumstances. Those skilled in the art will appreciate that many types of fasteners 32 are suitable for attaching angle plate 24 to the spacer plate 33 or downward facing side 16 of the mailbox, including: screws, bolts, and nails. Those skilled in the art will further realize that other methods for attaching angle plate 24 to the mailbox may be found, including the use of strips of self-adhesive material allowing the angle plate 24 to be affixed to the spacer plate 33 or downward facing side 16 of the mailbox. The side portion 28 of the angle plate 24 depends from the top portion 26 in a generally vertical direction and has a first end 34 and a second end 36. The first end 34 is disposed toward the front end 12 of the mailbox and has a pivot pin 35 formed thereon. The second end 36 is disposed toward the rear end 14 of the mailbox and has an upper arm 38 and a lower arm 40 extending rearward from the second end 34 forming a rearward opening notch 42 therebetween. The upper arm 38 has a length greater than the lower arm 40 thus forming a shoulder 44 on the upper side of the notch 42. The delivery signal device 22 further comprises a lever member 46 having a shank member 48 and an indicating member 50. The shank member 48 has a first end 52, a second end 54 and a central portion 56 therebetween. An elongated slot 58 is formed in the central portion 56 of shank member 48, slidably and pivotally engaging pivot pin 35 on the angle plate 24. The first end 52 of the shank member 48 has a friction surface 60 formed thereon. As shown in FIG. 6, when lever member 46 is in a generally horizontal position, opening the mailbox door 18 will cause the bottom edge 20 of the door to move downward and rearward, slidably contacting friction surface 60 of shank member 48 and producing a generally rearward force on lever member 46. An indicating member 50 is mounted on the second end 54 of the shank portion 48. The indicating member 50 is dimensioned to engage notch 42 in angle plate 24 when the lever member 46 has been pivoted until the shank member 48 encounters shoulder 44 and lever member 46 is further translated into a forward position. Indicating member 50 is further dimensioned to disengage notch 42 in angle plate 24 when a rearward force causes lever member 46 to translate rearward. Thus, to set the mail delivery signal device 22, the mailbox owner will first pivot lever member 46 until shank member 48 encounters shoulder 44. Next, the owner will slide lever member 46 forward until indicating member 50 engages notch 42. When the postal carrier opens the mailbox door 18, door bottom edge 20 will contact friction surface 60 of the lever member 46, producing a rearward force on lever member 46. Because of slot 58, lever member 46 can move rearward along pivot pin 35 until the indicator member 50 disengages notch 42. At this point weight of indicating member 50 will cause lever member 46 to pivot downward, exposing indicating member 50, thus signaling to the mailbox owner that the mail has been delivered. One skilled in the art will appreciate that indicating members of many configurations are suitable for use with this invention including round, rectangular, and triangular flags. In one embodiment, indicating member 50 includes a generally triangular flag 62 truncated at one apex and positioned such that an imaginary apex where an extension of the truncated side edges would come together is pointed along the shank member 48 towards the central portion 56. Those skilled in the art will also appreciate that indicating member 50 may be attached to the second end 54 of shank member 48 such that flag 62 is angularly repositionable, thus allowing the mailbox owner to position the flag for maximum visibility.

Referring to FIGS. 3 and 7, use of the current invention on a mailbox having "piano" hinges is described. The mailbox 80 has a front end 82, a rear end 84, a downward facing side 86, and a door 88 having a bottom edge 90 where door 88 is mounted on front end 82 of the mailbox using "piano" hinge 92 such that the bottom edge 90 of the door pivots about the hinge 92 when the door is opened. Delivery signal device 22 is attached to the downward facing side 86 of the mailbox. Since the bottom edge 90 of mailbox door 88 does not move below the front end 82 of the mailbox and rearward when said door is opened, cam plate 94 is provided. Cam plate 94 has mounting portion 96 and cam surface portion 98. Mounting portion 96 is attached to the mailbox door 88 at bottom edge 90. Those skilled in the art will appreciate cam plate 94 may be mounted to mailbox door 88 using a variety of methods including screws, bolts, adhesives, or other fastening means. Cam surface portion 98 depends from mounting portion 96 and extends generally downward past the bottom edge 90 of the mailbox door such that cam surface portion 98 moves beneath the front end 82 of the mailbox and rearward when the mailbox door 88 is opened. Those skilled in the art will appreciate that the exact structure of cam plate 98 is not critical to this invention and that a variety of structures could be substituted for it. Angle plate 24, lever member 46, and other components of delivery signal device 22 are as previously described and operation of the device generally follows the procedure previously described. However, as shown in FIG. 7, when the postal carrier opens the mailbox door, the bottom edge of the door does not rotate downward and below the front end of the mailbox to activate the delivery signal device. Instead, the cam surface portion 98 of the cam plate 94 will move downward and rearward under the front end 82 of the mailbox, with cam surface portion 98 contacting friction surface 60 on lever member 46, thereby forcing lever member 46 rearward, such that indicator member 50 will disengage from notch 42 and fall to its vertical position thereby signaling that the mail has been delivered.

Figure 8:
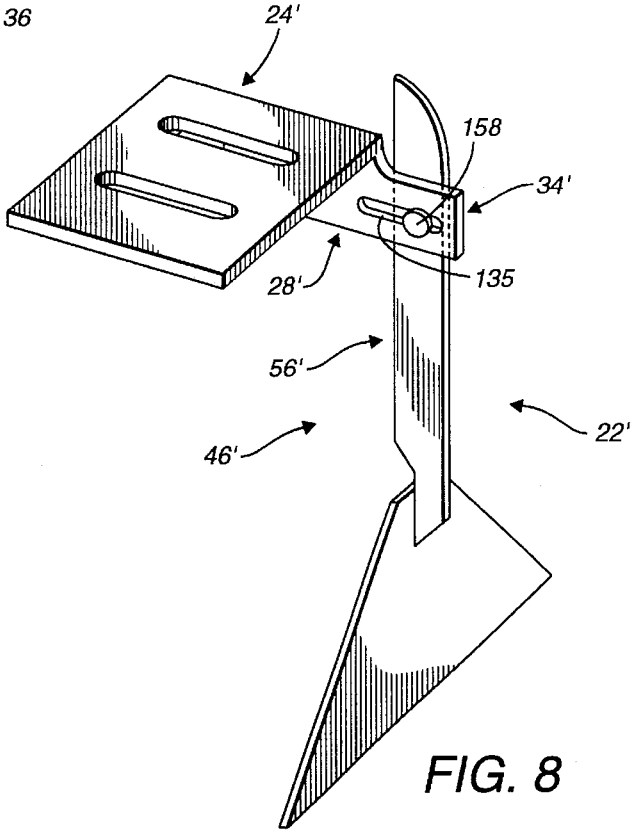
FIG. 8 is perspective view of an alternative embodiment of the delivery signal device in its signaling position without the mailbox shown.

Referring to FIG. 8, another embodiment of the present invention having an alternative configuration of the slide-pivot mechanism is shown. The delivery signal device 22' has components generally similar to corresponding numbered components in the previous embodiment. However, in this embodiment, first end 34' of side portion 28' of angle plate 24' has an elongated slot 135 formed therein, and central portion 56' of lever member 46' has a pivot pin 158 formed thereon. Pivot pin 158 slidingly and pivotally engages elongated slot 135. One skilled in the art will appreciate that operation of this alternative embodiment is similar to the procedure previously discussed.

Yet another embodiment of the current invention describes a kit for mounting the delivery signal device on new or existing mailboxes of different configurations. This embodiment includes all components of the delivery signal device as previously discussed and further includes a cam plate for use on mailboxes where it is needed.

Although the delivery signal device of the present invention has been described with respect to specific embodiments thereof, various changes and modifications to the preferred embodiments may be suggested to those skilled in the art, and it is intended that the present invention encompass such changes and modifications as fall within the scope of the appended claims.

I claim:

1. A signal device for a mailbox having a front end, a rear end, a downward facing side, and a door, said door mounted to the front end of said mailbox, said signal device comprising:

(a) an angle plate adapted for attachment to the downward facing side of said mailbox, said angle plate having a top portion and a side portion;

said top portion oriented generally horizontal;

said side portion depending from said top portion in a generally vertical direction and having first and second ends;

said first end having a pivot pin formed thereon;

said second end having upper and lower arms extending rearward from said second end forming a rearward opening notch therebetween, said upper arm having a length greater than said lower arm so as to form a shoulder on the upper side of said notch; and (b) a lever member having a shank member and an indicating member;

said shank member having first and second ends and a central portion therebetween;

said central portion having an elongated slot formed therein, said slot slidably and pivotally engaging said pivot pin on said angle plate;

said first end having a friction surface formed thereon;

said indicating member mounted on said second end of said shank member;

said indicating member dimensioned to engage said notch in said angle plate when said lever member has been pivoted until said shank member encounters said shoulder and said lever member has further been translated into a forward position; and said indicating member further dimensioned to disengage said notch in said angle plate when said lever member is translated rearward.

2. The device of claim 1 further comprising:

at least one slot formed in said top portion of said angle plate.

3. The device of claim 1 further comprising:

at least one strip of a self-adhesive material affixed to said top portion of said angle plate.

4. The device of claim 1 further comprising:

a spacer member affixed to said top portion of said angle plate;

at least one slot formed in said top portion of said angle plate.

5. The device of claim 4 wherein said indicating member further comprises a generally triangular flag truncated at one apex and positioned such that an imaginary apex where a projection of the truncated side edges would come together is pointing along said shank toward said central portion.

6. The device of claim 1 wherein said indicating member further comprises a flag that is angularly repositionable.

7. A kit for assembling a signal device adapted for attachment to a mailbox having a front end, a rear end, a downward facing side, and a door having a bottom edge, said door mounted to the front end of said mailbox, said kit comprising:

(a) an angle plate adapted for attachment to the downward facing side of said mailbox, said angle plate having a top portion and a side portion;

said top portion oriented generally horizontal;

said side portion depending from said top portion in a generally vertical direction and having first and second ends;

said first end having a pivot pin formed thereon;

said second end having upper and lower arms extending rearward from said second end forming a rearward opening notch therebetween, said upper arm having a length greater than said lower arm so as to form a shoulder on the upper side of said notch; and (b) a lever member having a shank member and an indicating member;

said shank member having first and second ends and a central portion therebetween;

said central portion having an elongated slot formed therein, said slot slidably and pivotally engaging said pivot pin on said angle plate;

said first end having a friction surface formed thereon;

said indicating member mounted on said second end of said shank member;

said indicating member dimensioned to engage said notch in said angle plate when said lever member has been pivoted until said shank member encounters said shoulder and said lever member has further been translated into a forward position; and said indicating member further dimensioned to disengage said notch in said angle plate when said lever member is translated rearward;

(c) a cam plate having a mounting portion and a cam surface portion;

said mounting portion for attaching said cam plate to said mailbox door at the bottom edge of said mailbox door;

said cam surface portion depending from said mounting portion and extending generally downward past the bottom edge of said mailbox door.

8. The kit of claim 7 further comprising:

at least one slot formed in said top portion of said angle plate.

9. The kit of claim 7 further comprising:

at least one strip of a self-adhesive material affixed to said top portion.

10. The kit of claim 7 further comprising:

a spacer member affixed to said top portion of said angle plate; and at least one slot formed in said top portion of said angle plate for receiving a fastener.

11. The kit of claim 10 wherein said indicating member further comprises a generally triangular flag truncated at ane apex and positioned such that an imaginary apex where a projection of the truncated side edges would come together is pointing along said shank toward said central portion.

12. The kit of claim 7 wherein said indicating member further comprises a flag that is angularly repositionable.

13. A signal device for a mailbox having a front end, a rear end, a downward facing side, and a door, said door mounted to the front end of said mailbox, said delivery signal device comprising:

(a) an angle plate adapted for attachment to the downward facing side of said mailbox, said angle plate having a top portion and a side portion;

said top portion oriented generally horizontal;

said side portion depending from said top portion in a generally vertical direction and having first and second ends;

said first end having an elongated slot formed therein;

said second end having upper and lower arms extending rearward from said second end forming a rearward opening notch therebetween, said upper arm having a length greater than said lower arm so as to form a shoulder on the upper side of said notch; and (b) a lever member having a shank member and an indicating member;

said shank member having first and second ends and a central portion therebetween;

said central portion having a pivot pin formed thereon, said pivot pin slidably and pivotally engaging said elongated slot in said angle plate;

said first end having a friction surface formed thereon;

said indicating member mounted on said second end of said shank member;

said indicating member dimensioned to engage said notch in said angle plate when said lever member has been pivoted until said shank member encounters said shoulder and said lever member has further been translated into a forward position; and said indicating member further dimensioned to disengage said notch in said angle plate when said lever member is translated rearward.

* * * * *